United States Patent [19]

Paden

[11] Patent Number: 5,033,131

[45] Date of Patent: Jul. 23, 1991

[54] BABY SHOWER

[76] Inventor: Jack R. Paden, 2833 31st Ave. S., Seattle, Wash. 98144

[21] Appl. No.: 383,160

[22] Filed: Jul. 20, 1989

[51] Int. Cl.[5] ..... A47K 3/024

[52] U.S. Cl. ..... 4/572; 4/568; 4/604; 4/611

[58] Field of Search ..... 4/560, 561, 572, 586, 4/597, 596, 604, 605, 611, 612, 621, 546, 548, 552, 553, 559, 571, 579, 554, 567, 570, 587, 588, 615

[56] References Cited

U.S. PATENT DOCUMENTS

| | | | |
|---|---|---|---|
| 1,073,435 | 9/1913 | Owsley | 4/572 |
| 2,252,428 | 8/1941 | Kennedy et al. | 4/587 X |
| 2,581,883 | 1/1952 | Rechler | 4/587 X |
| 3,619,823 | 11/1971 | Sackett | 4/572 X |
| 4,287,618 | 9/1981 | Silver | 4/420.3 X |
| 4,337,540 | 7/1982 | Lindeman | 4/612 |
| 4,466,146 | 8/1984 | Regan | 4/572 X |

FOREIGN PATENT DOCUMENTS

| | | | |
|---|---|---|---|
| 128405 | 11/1900 | Fed. Rep. of Germany | 4/621 |
| 818398 | 7/1949 | Fed. Rep. of Germany | 4/615 |
| 354910 | 7/1961 | Switzerland | 4/612 |

*Primary Examiner*—Charles E. Phillips

*Attorney, Agent, or Firm*—Roy E. Mattern, Jr.

[57] ABSTRACT

An infant or small child stands on an adjustable height platform within a containment in the form of a hollow support while being showered with water, via a flexible hose or tube from an existing water supply, to a shower spray nozzle adjustably affixed to the shower containment's sidewall. The shower spray nozzle adjusts vertically to direct water spray at various levels on the infant or small child's body. The shower spray nozzle is easily removable for hand held use and even more precise control of the water spray. The invention is adapted for support on a single rail of a conventional bathtub, and adjustable to fit various width tub rails. The invention alternatively stands on three legs providing for use in a conventional shower stall. The general configuration of the shower containment provides restriction of the infant or small child from standing too far off center of the shower containment in its lower portion, and ample room in its upper portion to allow the person giving the shower to have their hands and forearms within the shower containment and about all sides of the infant or small child. Water entering the shower containment runs down through or around the platform the child is standing on, and on out the shower containment's bottom drain into the bathtub or shower stall or other receptacle of choice.

6 Claims, 3 Drawing Sheets

20
10
12
14
54
56
44-44
42
46-46
58-60
62
16
70
46-46
44-44
42
68-68
60-60
58-58
66-66
64-64
69-69

78A
76
70
80
72
74
78

28
24
30
32
32A
32B
32C
30A
26

BABY SHOWER

BACKGROUND OF THE INVENTION

This invention relates to the shower bathing of infants and small children, too young to shower themselves in a conventional bathtub, tub shower or shower stall. More particularly, this invention is concerned with infants and small children who are capable of standing on their own, with the aid of a structure to grasp for support and balance.

The age range of infants and small children most appropriate to use this invention is from approximately seven months old to approximately three and one-half years old. This time frame closely relates to what is commonly referred to as the diaper stage, of a child.

As well as general showering, it is a very desirable procedure to be able to wash or shower an infant or small child's mid-section between diaper changes.

This invention provides for a parent or other responsible individual, a means for showering a child partially or completely, and more particularly, safely and conveniently in a containment supported on a single rail of a conventional bathtub, or free-standing in a conventional shower stall.

In the setting of conventional facilities, there exists a number of disadvantages and hazardous conditions that preclude the value of showering a child in this age range, and therefore it is not common practice to do so.

For example, bathtubs, shower stalls, wash basins, lavatories and sinks are in general dangerously hard and slippery surfaces. A child of this age group is very difficult to hold safely in the above mentioned facilities, which also have protruding fixtures that pose as hazardous objects to bump against, or as something to grab onto.

In addition, to effectively shower and wash a child, it would be convenient to have both hands free to do so. This is not possible while trying to hold and maintain the child's position.

There is also the need to direct the shower of water to the parts of the child's body determined necessary for effective cleaning, especially the mid-section, when showering between diaper changes.

Another requirement is to be able to control the over spray of water in order to not wet down the surrounding environment.

To the best of my knowledge, the aforementioned barriers have not been addressed collectively in the form of an invention for showering infants and small children, safely and conveniently in the setting of conventional facilities, or any setting.

SUMMARY

In consequence of no known prior art and the disadvantages and potential hazards of showering a child as outlined prior, it is therefore a general object of this invention to provide a shower that an infant or small child can stand in, grasp for support and balance, and be at a convenient height above the floor. Water supplied by the facility's existing plumbing via a quick disconnect fitting and a conventional splitter valve at the facility's shower stem pipe, or tub filler spout, travels through a flexible hose or tube to a shower spray nozzle affixable to a sidewall of the invention. This shower spray nozzle is vertically adjustable to afford precise control of the water spray on the child. The person showering the child then has both hands free to manipulate and wash the child.

The water then passes through or around a vertically adjustable platform the child is standing on and out the containment's base in a continuous manner into the bathtub or shower stall.

It is a further object of this invention to provide a baby shower with a shower spray nozzle adjustably affixed to its sidewall that can be easily removed and held in the palm of the hand for a more precise control of the water spray.

It is an additional object of this invention to provide a baby shower with an adjustable platform to accommodate various height children for optimum safety and convenience.

It is yet another object of this invention to provide a baby shower with a pair of support members extending horizontally and outwardly from a mid-position of the shower containment, acting as hooks for attachment to a single rail of a conventional bathtub, whereby its rotational moment thrusts its lowermost center point against the interior wall of the bathtub, resulting in a cantilever form of support.

Additional still, it is another object of this invention to provide a baby shower with a pair of support members, extending horizontally and outwardly from a midpoint of the shower containment for a means of support when engaged with the top of the bathtub rail and be also adjustable in their outward extension to accommodate various width tub rails and when fully retracted, minimize space required for storage, and allow the invention to hang on a vertical wall surface for storage between usages.

In continuation it is another object of this invention to provide a baby shower having at its base where shower water exits the shower containment, an easily attachable and detachable vessel for capturing debris that would otherwise be deposited in the bathtub or shower stall.

It is yet another object of this invention to provide a baby shower containment of a configuration that totally surrounds but does not totally enclose the child. The lower portion being of minimal horizontal cross sectional area and providing ledges protruding inwardly from its vertical walls to support a platform at various levels and have adequate surface area for the child to stand on, but restricting the child from walking around and too off center of the shower containment's center of gravity. The upper portion of the containment having a greater horizontal cross-sectional area, allowing ample room for the person giving the shower to place their hands and forearms into the shower containment and around and about all sides of the child. It is preferred to have the shower containment of a one piece molded plastic construction.

In addition to the basic form of the shower containment portion of the baby shower as an object of functionality, a feature on the sidewall of the containment for affixing adjustably a shower spray nozzle, comprises a vertical slot where at its uppermost end, enters into an enlarged circular opening. The spray nozzle enters through the enlarged opening at the top of the slot and by means of a spring loaded guide for gripping the shower containment wall about the slot, may be positioned and held in place at any point along the vertical slot. This, then allows the water to spray on the child's body at various levels.

Still in addition, it is another object of this invention to provide a baby shower to be self-sufficient for use in locations where tub or shower facilities do not exist, such as camping and traveling. This is accomplished by fitting the invention as described with two tanks. The first tank adapted to surround the shower containment's lower portion, comprising a filler opening with a cap, an internal manual piston pump, and an outlet port to provide pressurized water to the shower spray nozzle. The second tank is adapted to reside below the first tank and in alignment with the shower containment's bottom drain, acting as a base support for the entire assembly and a storage tank for drain water.

In accordance with the above objects, an embodiment of this invention, in summary, comprises a containment in the form of a hollow support for the purpose of showering infants and small children, supported on a single rail of a conventional bathtub or free-standing in a conventional shower stall with its own shower spray nozzle, adjustably affixed to the containment's sidewall and supplied with water flow from a facility's existing plumbing via a flexible hose or tube, while draining its used water through or past an adjustable height platform supporting a child, and on down and exiting the containment's base to the bathtub or shower stall's floor.

The spray nozzle is easily removable for holding in the palm of the hand for a more precise control of the water spray.

At the shower containment's approximate mid-section, and surrounding its exterior and perpendicular to its vertical axis, is a support frame securely attached to the containment's walls, and houses two sliding members. These members function as beams for support and may be rectangular or any other non circular shape in cross section to resist rotation within the support frame, and slide linearly in and out of the support frame.

These two beams are independent of one another and are angularly directed away from each other, so that when they are extended outwardly from the support frame, their leading ends progressively grow more distant of one another. This spreading action generates a wider base for support when resting on the top of the tub rail.

At the leading end of each of these beams, and at a right angle to them and in a downward direction, there are extensions in the form of freely rotating cylindrical members. These members act as stops, or hooks, to keep the shower containment from falling in the direction of the bathtub's interior.

This direction of force against the cylindrical stops or hooks, results from a point of contact at the lowermost point of the shower containment and the inner wall of the bathtub, thereby acting as a pivot point to direct some of the vertical forces into the horizontal plane, resulting in a cantilever form of support.

The beams are linearly adjustable to span different width tub rails, but once this span is determined, their sliding action is positively latched in place. This latching may be accomplished any one of a number of methods, preferred though, is an adjustable peg and stop design shown.

Three cavities or sockets are provided in the bottom face of the support frame at the shower containment's approximate midsection. Three legs are insertable with respect to these sockets, in their triangulated pattern of placement. Using the legs for support in a free-standing mode is an alternative to using the support members extended over the rail of a bathtub. This allows for use in a shower stall where there is no tub rail and also permits a child to shower with a parent or other responsible individual.

Additionally, for use in locations where tub or shower facilities do not exist, such as camping and traveling, the invention is fitted with two storage tanks, one for fresh shower water and the other for drain water as described prior.

DESCRIPTION OF PREFERRED EMBODIMENTS A GENERAL ARRANGEMENT

Figure 1:
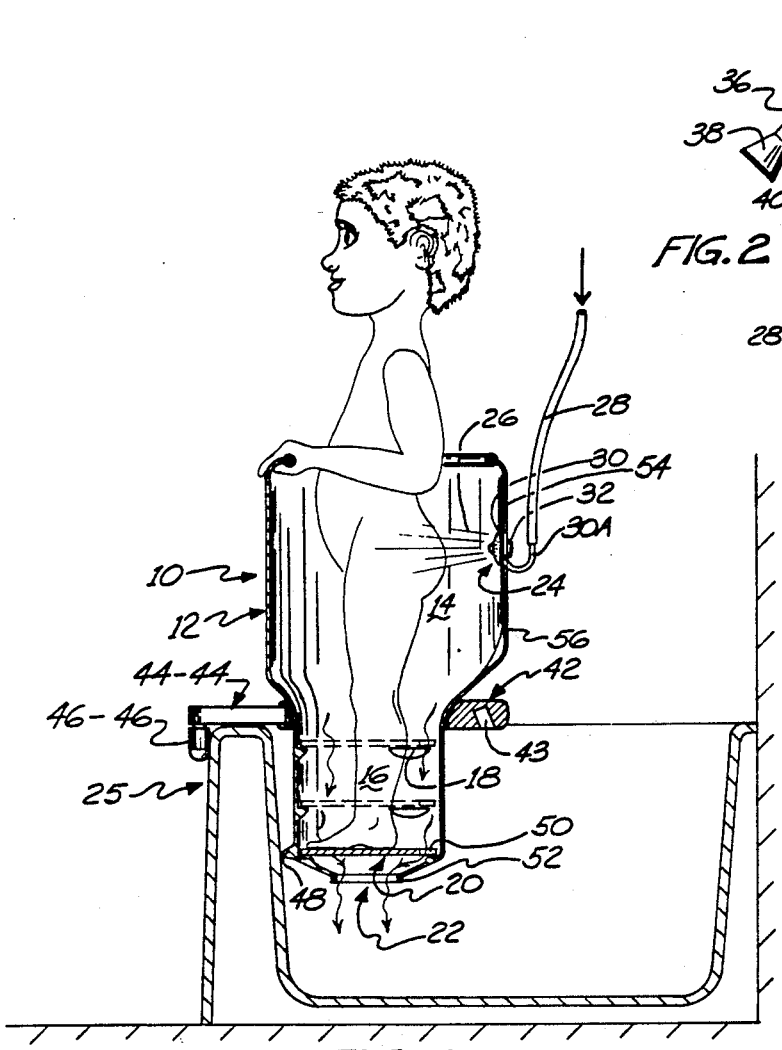
FIG. 1 is a sectional side elevation showing the invention, a baby shower, in use in the tub rail mounted mode. This view shows a child standing on the platform in its lowermost position while the shower spray nozzle is directing water to the child's mid-section, resultingly the water draining through the containment's base and into the bathtub. Also shown is the lowermost point of the shower containment in contact with the inner wall of the bathtub.

In the sectional elevation view of FIG. 1 the general organization of a preferred embodiment of this invention, a baby shower 10, is shown, in use wherein an infant or small child is standing in a containment 12 and with the aid of its structure supporting himself or herself. The child's feet are supported by a platform 20 in the containment's lower portion 16 and the shower containment 12 as a unit is shown supported on a single rail of a conventional bathtub 25 by a pair of freely rotating cylindrical members 46—46 hooking over the outside vertical wall of the bathtub 25 and a pair of horizontal support members 44—44 resting on top of the tub rail. The horizontal support members 44 are adjustably attached to a support frame 42 which surrounds and is securely attached to the shower containment 12 about its approximate mid-section. The horizontal support members 44—44 are adjustably attached to the support frame 42 for the purpose of spanning various width tub rails and to reduce space required for storage when fully retracted. When a lowermost point on the shower containment 48 is in contact with the interior vertical wall of the bathtub 25, a cantilever form of support is achieved.

Figure 2:
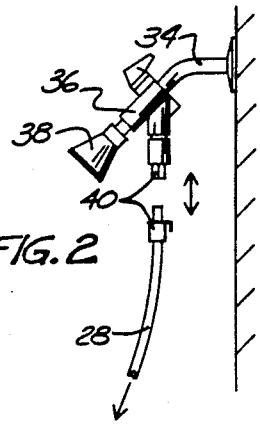
FIG. 2 illustrates a conventional shower head and stem pipe protruding from the wall of the conventional tub-shower facility depicted in FIG. 1. This displays a conventional splitter valve and quick-disconnect fitting convenient for supplying water to the invention's shower spray nozzle.

Water via the existing plumbing, as shown in FIG. 2, is tapped off the facility's stem pipe 34 or the tub filler spout (not shown) by diverting the flow of water through a conventional splitter valve 36 and on through a quick disconnect fitting 40 and on through a flexible hose or tube 28 to a shower spray nozzle 24 for use as part of the invention and either adjustably affixed to the shower containment sidewall as shown, or for hand held use.

While the child is being showered within the shower containment 12, the used water passes down and through or around the platform 20 and on out the shower containment's bottom drain 22 on to the floor of the bathtub or shower stall.

CONTAINMENT—PLATFORM—BOTTOM DRAIN

Figure 3:
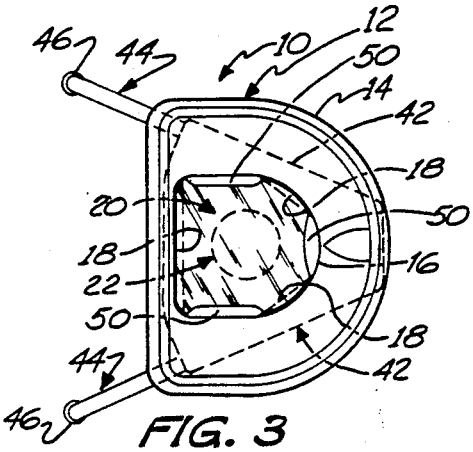
FIG. 3 is a top view of the invention, a baby shower, showing the upper and lower portions of the containment's preferred circumferential profile, the platform in the upper level position and the support arms extended.
Figure 4:
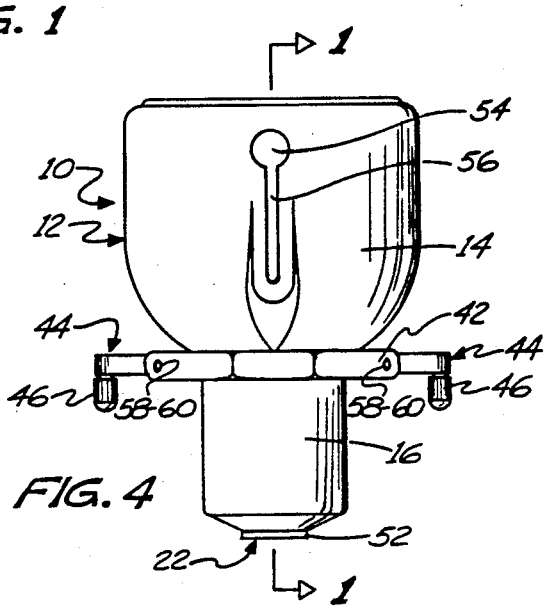
FIG. 4 is a rear elevation, again the support arms are in an extended position.

Referring to FIG. 1, the invention, a baby shower 10, is shown in the form of a containment 12 with its upper portion 14 of a greater cross sectional area best seen in FIG. 3 in plan view and FIG. 4 in a rear elevational view to allow the person giving the shower to place their forearms and hands within the containment 12, and about all sides of the infant or small child. The containment's lower portion 16 is of a lesser horizontal cross sectional area to confine the child's feet to standing as close as possible to the containment's center of gravity. In FIGS. 1 and 3, shown are ledges protruding inwardly from the containment's sidewalls and the platform's perimeter.

SHOWER SPRAY NOZZLE

In FIG. 1, the shower spray nozzle 24 is shown directing a water spray 26 onto the mid-section of a child. The shower spray nozzle 24 has a plurality of holes in its face, acting as a manifold, converting a single flow of water into a spray pattern typical of the principle of a spray nozzle of this design. The body 30 of the shower spray nozzle 24 has on its side opposite the spray openings, a spring loaded guide flange 32 to grip the sidewalls of the shower containment 12 on both its inner and outer surfaces and both sides of the vertical slot 56 shown best by the rear elevation of FIG. 4 and the perspective of FIG. 7. The shower spray nozzle 24 will be described in more detail later. This frictional connection is referred to as "adjustably affixed", allowing the shower spray nozzle 24 to slide within the vertical slot 56 and be held in place at any point along the way. The circular opening 54 at the uppermost end of the slot, acts as a passageway for the shower spray nozzle 24 to be taken out of the shower containment 12 when slid up the vertical slot 56 into the opening 54. In FIG. 1, a rigid conduit coming from the body 30 of the shower spray nozzle 24 on the side opposite the spray openings, is attached to a flexible hose or tube 28 leading to the facility's existing plumbing for a source of shower water.

SUPPORT FRAME AND SUPPORT MEMBERS

In FIGS. 1, 3, 4, and 7 shown is the support frame 42 attached to the approximate mid-section of the shower containment 12. In FIG. 1 the horizontal support member 44 is shown resting on top of the single rail of a conventional bathtub 25. The freely rotating, vertical cylindrical member 46 is in contact with the outer surface of the tub rail acting as a stop or a hook to keep the invention, a baby shower, from falling in the direction of the bathtub's interior. This falling moment is about a point of contact at the shower containment's lowermost point 48 with the interior vertical surface of the bathtub wall. The relationship of this connection between the invention, a baby shower, and the rail top and vertical walls of a bathtub, result in a cantilever form of support.

Figures 5, 6, 7, 8:
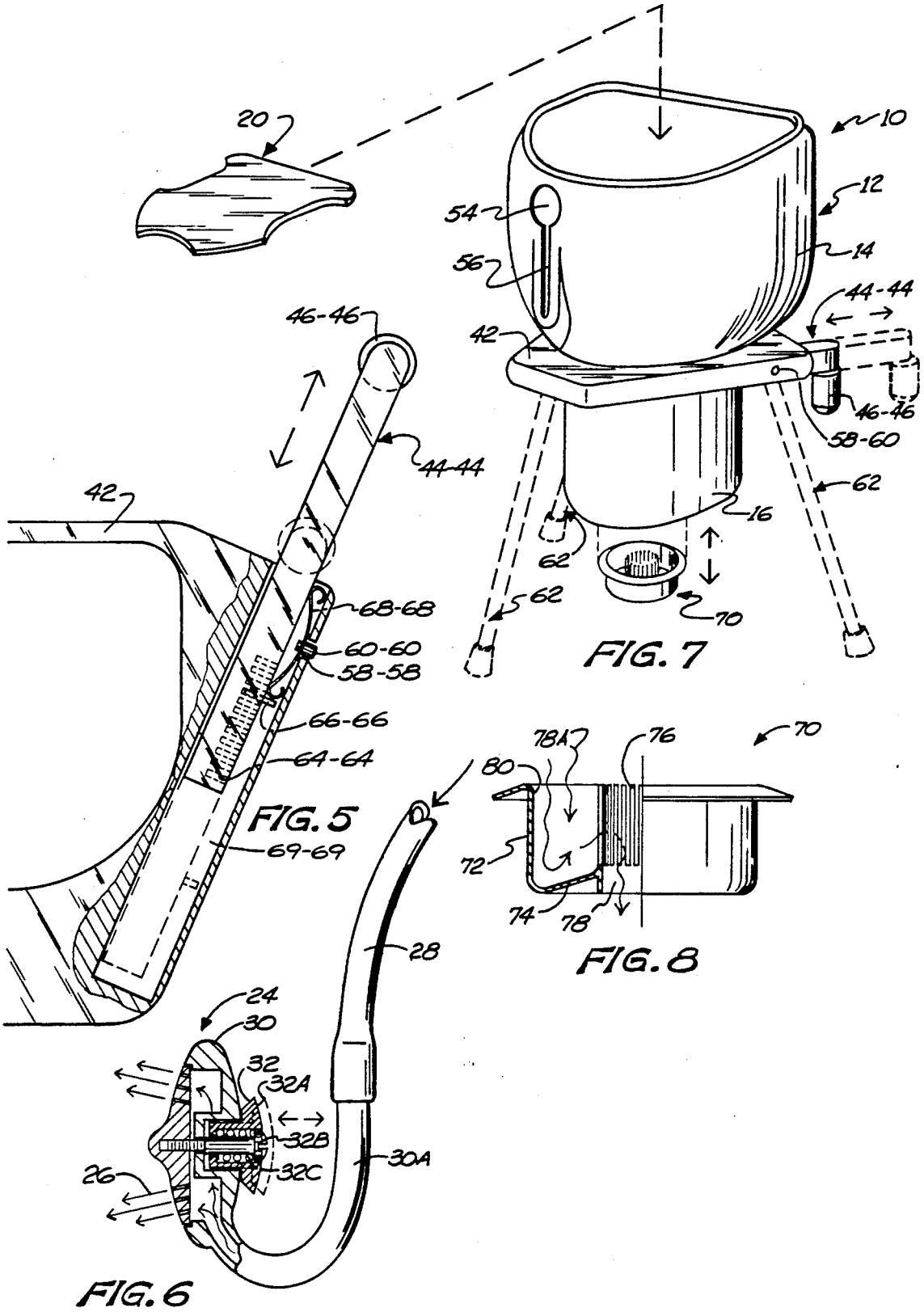
FIG. 5 is a plan view of the support frame partially sectioned to reveal the mechanics of one of the two sliding support arms' adjustable stop mechanism.
FIG. 6 is a side view in partial section of a shower spray nozzle, illustrating its functional form for holding in the palm of the hand, and its mechanics for attachment to the containment's sidewall.
FIG. 7 is a perspective of the invention, a baby shower, in the free-standing mode, showing leg locations, platform removed and the drain filter trap removed from its mounting point.
FIG. 8 is a side view of the drain filter trap in partial section.

Also shown in FIG. 1 is one of the three leg sockets 43—43—43 provided in the bottom side of the support frame 42 for easy attaching and detaching three legs 62—62—62 in FIG. 7. This provides a free-standing mode for use in a conventional shower stall where no tub rail exists. Also, a function of the free-standing mode, it provides a means for an infant or small child to shower with a parent or other responsible individual, while being contained, and at a convenient height from the floor of the shower stall.

SHOWER SPRAY NOZZLE ASSEMBLY

FIG. 6 shows the shower spray nozzle in partial section. Water carried by flexible hose or tube 28 enters a rigid conduit 30A and passes into the symmetrical cavity of the shower spray nozzle's body 30 where it's forced out a plurality of holes in the shower spray nozzle's face, resulting in a water spray 26. The curved shape of the rigid conduit 30A, joining the body 30 near its perimeter and extending radially outward and curving back to pass behind the body at mid-position and parallel to it, provides a means for placing the shower spray nozzle body in the palm of the hand while the rigid conduit directs the flexible hose or tube up the back of the hand of the user.

Centrally recessed from the side of the body 30 opposite the spray openings, is a cavity for the purpose of recessing a spring loaded guide flange 32. At the center of this cavity, and also at center to the entire symmetry of the body, a shoulder screw 32B is used to compress a coil spring 32C partially and against the bottom of a cylindrically shaped sleeve surrounding the coil spring, a portion of this cylindrical sleeve extends outwardly from the body 30 and is flanged radially outward to form a surface that is in communication with the surface of the body 30 facing it. When the shower spray nozzle is affixed to the shower containment 12, both sides of the vertical slot 56 are forced between the guide flange and the body of the shower spray nozzle 30, separating the flange from the body. The coil spring 32C then mains a frictional grip by compressing the sidewall on both sides of the vertical slot 56 between the guide flange 32 and the body 30.

ADJUSTABLE HORIZONTAL SUPPORT MEMBER ASSEMBLY

In FIG. 5, a partial sectional view of one side of the support frame 42 shows one of the two horizontal support members 44—44 and its telescopic relationship with the support frame 42. Each of the two horizontal support members are independent of one another and of identical configuration. Therefore, a horizontal support member assembly comprises the following: a beam of adequate length, hollow or solid, with a cross sectional shape that resists rotation about its longitudinal axis when engaged with a surrounding channel of a telescopic fit. Preferred and shown in FIG. 5 is a rectangular shape. Extending downwardly and at a right angle to its axis, at one end of this member, is a freely rotating cylindrical member 46—46 acting as a stop or hook to keep the invention, a baby shower, from falling in the direction of the bathtub's interior. The surface of these stops or hooks are of a material yielding a high coefficient of friction when in contact with the commonly enameled surface of a conventional bathtub, such as vinyl. To adjust the horizontal support member 44—44 for given tub rail span, the user chooses the appropriate socket, in a row of sockets 64—64 along the outside vertical face starting near the end of the member opposite the freely rotating cylindrical member 46—46, and places a flat peg 66—66 in that socket. The portion of the flat peg 66—66 protruding then becomes a stop point that travels along with the telescopically sliding horizontal support member 44—44. The telescopic channel 69—69 within the support frame 42 is of a proportion to provide minimum clearance with the horizontal support member 44—44 in the vertical plane, but of a much greater clearance in the horizontal plan. This is to provide clearance for the protruding flat peg 66—66. An arc spring 68—68 is, with pre-load, forced into the clearance space of the telescopic channel 69—69 between the vertical face of the horizontal support member, with the protruding flat peg 66—66, and the opposing inside surface of the telescopic channel 69—69, the arc spring 68—68 held in place by a peg 60—60 protruding from the midpoint of its convex side, and engaging with a hole 58—58 in the same side of the telescopic channel's inside surface. The arc spring has two functions. One, to act as a stop point when in contact with the flat peg 66–66 on the horizontal support member 44—44, and the other to maintain pressure against the horizontal support member 44—44 to keep it from sliding freely about.

DRAIN WATER FILTER

In FIG. 8, the partial elevation of a side view of the drain water filter 70 shows its continuous vertical sidewall 72 and its generally horizontal bottom 74 and open top. Central to its horizontal bottom is a second opening 78 of approximately one-half the area of its open top. This opening 78 is surrounded by a vertical wall of a height equal to that of its continuous sidewall. The general appearance of this filter vessel is of a cylinder within a cylinder, jointed by a common bottom, but, the smaller inside cylinder or vertical wall 76 surrounding the bottom opening 78 consists of a multitude of vertical slots from top to bottom, the slots constituting a minimum of 40 percent of the vertical wall's surface area.

This filter vessel is easily attachable to and detachable from a flange 52 circumferential to the bottom drain 22 opening of the shower containment 12, see FIG. 1 and FIG. 4 and FIG. 7. The upper inner circumferential surface 80 of the filter vessel 70 is an interference fit with the shower containment's flange 52 when filter vessel is in use. Water 78A enters the open top of the vessel peripheral to the slotted vertical wall 76 and passes through the slots and to drain down and out the bottom opening 78. Any debris too large to pass through the slots is retained within the drain water filter 70.

SELF-CONTAINED WATER SUPPLY AND DRAIN WATER STORAGE

Figure 9:
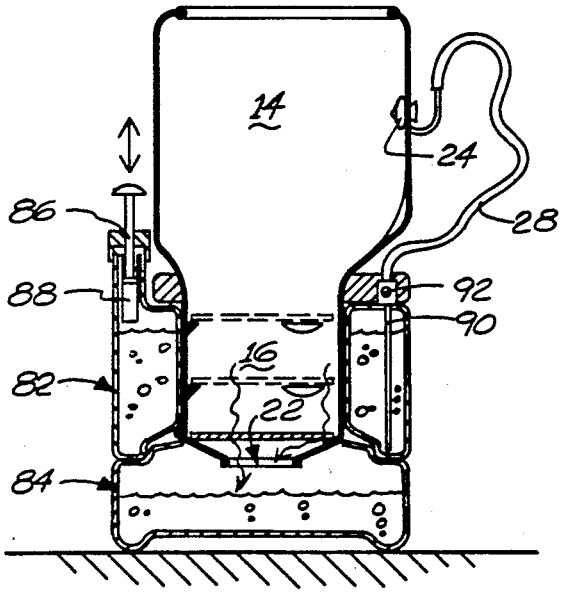
FIG. 9 is a full section of the invention in a self-contained configuration showing the fresh water storage tank and the drain water storage tank.

In FIG. 9, a sectional elevation, is shown the invention, a baby shower 10, with its containment 12 surrounded in its lower portion 16 by a plastic molded tank 82 for storing fresh water. A manual piston pump 88 built into a filler cap 86 is used to raise the internal pressure of the tank, forcing water through a pick-up tube 90 to a control valve 92 which allows water to flow through a flexible hose or tube 28 to the shower spray nozzle 24. A second plastic molded tank 84, adapted to interlock with the fresh water tank 82 above it, and with a top opening in communication with the shower containment's bottom drain 22 acts as a base support for the entire assembly and a storage tank for drain water.

Figure 10:
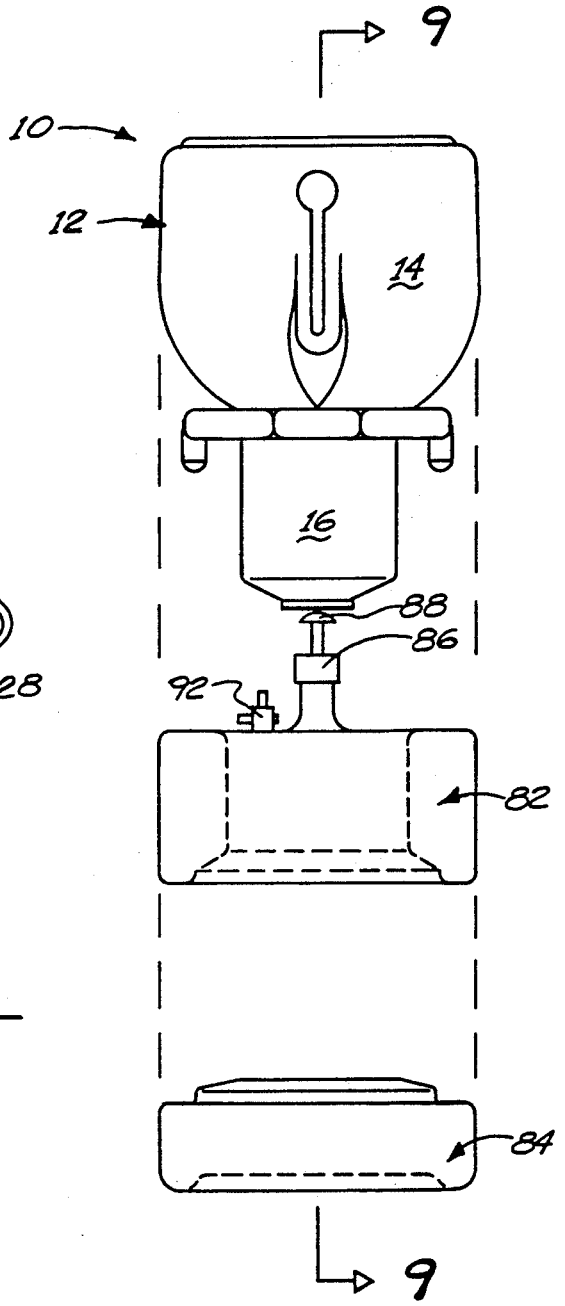
FIG. 10 is an exploded view of the self-contained arrangement.

FIG. 10 shows separately the assemblies involved in the self-contained arrangement. The invention, a baby shower 10, as a unit, the fresh water storage tank 82 and the drain water storage tank 84.

This self-contained arrangement provides use of the "baby shower" in locations where conventional facilities do not exist, such as while traveling, camping, etc.

I claim:

1. A shower used in showering an infant or small child, while he or she is standing, comprising:

a) a containment in the form of a hollow support to partially surround an infant or small child who is standing having an open top, continuous sidewalls, and a bottom continuous drain, the height of the continuous sidewalls permitting the infant or small child who is standing to grasp the top of the continuous sidewalls to support himself or herself in a standing position while being showered;

b) a means for controlling a water spray directed towards a standing infant or small child; comprising in turn:

i) a shower spray nozzle; and ii) a means to adjustably affix the shower spray nozzle to the sidewall of the shower containment, comprising in turn:

a vertical slot in the containment's sidewall providing access for the shower spray nozzle to both the inner and outer surfaces of the containment's sidewall whereby the shower spray nozzle is adapted to frictionally grip said surfaces, thereby allowing the shower spray nozzle to be slidable to, and held in, an infinite choice of vertical locations within the vertical slot, whereas the adaptation of the shower spray nozzle to frictionally grip said surfaces comprises a spring loaded guide flange extending outwardly from the shower spray nozzle's side opposite the spray openings whereby, when affixed to the containment's sidewall, the shower spray nozzle's body is in contact with the containment's interior surface on both sides of the vertical slot, and the guide flange is in contact with the containment's exterior surface on both sides of the vertical slot.

2. A shower used in showering an infant or small child, while he or she is standing, comprising:

a) a containment in the form of a hollow support to partially surround an infant or small child who is standing having an open top, continuous sidewalls, and a bottom continuous drain, the height of the continuous sidewalls permitting the infant or small child who is standing to grasp the top of the continuous sidewalls to support himself or herself in a standing position while being showered;

b) a means for controlling a water spray directed towards a standing infant or small child; comprising in turn:

i) a shower spray nozzle; and ii) means to adjustably affix the shower spray nozzle to the sidewall of the shower containment, so the shower spray nozzle is adaptable to permit each removal of the shower spray nozzle to afford hand held use of the shower spray nozzle, comprising, in turn:

an aperture in the containment's sidewall, adequate in size to allow the shower spray nozzle to pass through; a vertical slot in the containment's sidewall, and the aperture located at the upper end of the vertical slot, thereby providing for disengagement of the shower spray nozzle when slid up the vertical slot and into said aperture.

3. A shower used in showering an infant or small child, while he or she is standing, comprising:

a) a containment in the form of a hollow support to partially surround an infant or small child who is standing having an open top, continuous sidewalls, and a bottom continuous drain, the height of the continuous sidewalls permitting the infant or small child who is standing to grasp the top of the continuous sidewalls to support himself or herself in a standing position while being showered;

b) a multiple vertical positions means for supporting the feet of a standing infant or small child above the bottom continuous drain of the shower, comprising, in turn:

support ledges protruding inwardly from the shower containment's sidewalls, sufficient and so placed to provide support for a platform to reside at various levels relative to the vertical axis of the shower containment.

4. A shower used in showering an infant or small child, while he or she is standing, comprising:

a) a containment in the form of a hollow support to partially surround an infant or small child who is standing having an open top, continuous sidewalls, and a bottom continuous drain, the height of the continuous sidewalls permitting the infant or small child who is standing to grasp the top of the continuous sidewalls to support himself or herself in a standing position while being showered;

b) a means for support on a single rail of a conventional bathtub, comprising in turn:

i) two horizontal support members extending outwardly from the shower containment's approximate midsection serving as a support against the vertical forces of gravity acting on the shower and its contents while the horizontal support members are in contact with the top surface of a single rail of the bathtub and having adjustable means to accommodate various width bathtub rails; and ii) a vertical member extending downward to a right angle to each of the horizontal support members at their free ends, acting as stops to contain the horizontal forces resulting from a point of contact at the shower containment's lowermost point with the inside surface of the bathtub, thereby creating a cantilever form of support.

5. A shower as claimed in claim 4 whereby the adjustable means to accommodate various width bathtub rails, comprises two horizontal support members telescoping within a support frame that is attached about the approximate mid-section of the shower containment, whereby a cross sectional profile of a telescoping horizontal support member is of a shape not allowing rotation of the horizontal support members within the support frame, and the telescoping action of these horizontal support members provides the spacial adjustment, and the limit of extension of these horizontal support members is predetermined by the user by placing a peg in a selected socket within a row of sockets along a side of each horizontal support member, said peg, as a stopping point that travels with the telescoping horizontal support member, encounters a stop point within the support frame comprising:

an arc spring having a peg protruding away from its convex side at mid-point, said peg engages with a hole within the support frame while the two ends of the arc spring on the concave side, ride against the slidable side surface of the horizontal support member for the purpose of keeping the horizontal support member from telescoping freely about and as the stop point.

6. A shower used in showering an infant or small child, while he or she is standing, comprising:

a containment in the form of a hollow support to partially surround an infant or small child who is standing having an open top, continuous sidewalls, and a bottom continuous drain, the height of the continuous sidewalls permitting the infant or small child who is standing to grasp the top of the continuous sidewalls to support himself or herself in a standing position while being showered, and the shower containment is configured to fully surround, but not fully enclose an infant or small child, and have a substantially lesser horizontal cross sectional area in its lower portion than in its upper portion, for reasons of restricting the infant or small child from standing too far off center of the shower containment in its lower portion, and providing ample space between the infant or small child and the side wall of the shower containment in its upper portion, for the person giving the shower to have their forearms and hands about the infant or small child.

* * * * *